US005341581A

United States Patent [19]

Huang

[11] Patent Number: 5,341,581

[45] Date of Patent: Aug. 30, 1994

[54] COMPRESSION COOLING SYSTEM OF SHOE MIDSOLE

[76] Inventor: Kinger Huang, No. 34, Wu-Chang Rd., Taichung, Taiwan

[21] Appl. No.: 120,792

[22] Filed: Sep. 15, 1993

[51] Int. Cl.[5] ..... A43B 7/06; A43B 13/20

[52] U.S. Cl. ..... 36/3 B; 36/29

[58] Field of Search ..... 36/3 R, 3 B, 29

[56] References Cited

U.S. PATENT DOCUMENTS

| | | | |
|---|---|---|---|
| 3,225,463 | 12/1965 | Burnham | 36/29 X |
| 4,102,061 | 7/1978 | Saaristo | 36/3 B X |
| 4,602,441 | 7/1986 | El Sakkaf | 36/3 B X |
| 4,654,982 | 4/1987 | Lee | 36/3 R X |
| 4,835,383 | 6/1989 | Tetrault et al. | 36/3 B X |
| 4,860,463 | 8/1989 | Pin | 36/3 B |
| 5,010,661 | 4/1991 | Chu | 36/3 B |
| 5,179,792 | 1/1993 | Brantingham | 36/3 B X |
| 5,195,254 | 3/1993 | Tyng | 36/3 B X |
| 5,224,277 | 7/1993 | Sang Do | 36/3 B X |

*Primary Examiner*—Jimmy G. Foster
*Assistant Examiner*—BethAnne C. Cicconi
*Attorney, Agent, or Firm*—Browdy and Neimark

[57] ABSTRACT

A compression cooling system of a shoe midsole comprises mainly a main body, an air sac and an air duct. The air sac is disposed in the main body such that the air sac is corresponding in location to the heel of a shoe. Two one-way valves are disposed on predetermined portions of the air sac. The air duct has one end that is connected with one of the two one-way valves and has another end that extends to reach the upper surface of the shoe midsole. The treading and the jogging actions of the foot wearing the shoe bring about the pumping effect of the air sac, thereby generating a stream of suction to cause the air inside and outside the shoe to circulate.

7 Claims, 5 Drawing Sheets

COMPRESSION COOLING SYSTEM OF SHOE MIDSOLE

FIELD OF THE INVENTION

The present invention relates generally to a shoe midsole, and more particularly to a shoe midsole having a compression cooling system capable of causing the air inside and outside the shoe to circulate and of absorbing the shock.

BACKGROUND OF THE INVENTION

A shoe, especially an athletic shoe, is generally composed of an outsole which makes direct contact with the ground surface, a midsole of elastic material and arranged on the outsole, a shoe upper of an appropriate height and extending upwards from the periphery of the midsole, and an insole disposed on the midsole and surrounded by the shoe upper. The insole and the shoe upper form together a space to accommodate a human foot. The insole and the midsole serve to enhance the wearing comfort of the shoe.

The athletic shoe described above is generally defective in design in that the shoe is poorly ventilated that the heat and the perspiration of the foot wearing the shoe are bound to remain in the space surrounded by the shoe upper, thereby producing the foul air inside the shoe.

With a view to improving the ventilation of the shoe, the shoe upper is provided with some breathing holes in communication with the inside of the shoe. However, such breathing holes are not effective in letting out the foul air for the reasons which are expounded hereinafter.

The ventilating effect of the breathing holes is often undermined by the fact that the foot wearing the shoe obstructs the passage of the foul air as well as the fresh air.

The foot and the shoe upper covering the foot form a sealed space which is incapable of letting out the foul air and of letting in the fresh air.

In order to overcome the shortcomings of the conventional shoe described above, some of the shoe makers have introduced a new kind of shoe midsole which is provided therein with a compressible hollow interior capable of driving out the foul air, as exemplified in the Taiwanese Patent Number 134162. However, the cost of making the compressible midsole of the prior art is prohibitively high in view of the fact that the compressible hollow interior of the midsole must be formed by the method of hollow die casting. In addition, the air ducts so formed are often obstructed easily, thereby undermining the airing effect of the prior art midsole. As a result, such prior art midsole has never been accepted enthusiastically by the shoe makers at large.

SUMMARY OF THE INVENTION

It is therefore the primary objective of the present invention to provide a shoe midsole with a compression cooling system capable of circulating the air inside and outside the shoe and of moderating the heat generated by the foot wearing the shoe.

It is another objective of the present invention to provide an improved midsole with a shock-absorbing means.

The foregoing objectives of the present invention are accomplished by a midsole compression cooling system, which comprises a main body, an air sac disposed in the main body, and an air duct embedded in the bottom of the main body. The air sac is disposed in the interior of the midsole such that the air sac is corresponding in location to the heel. The air sac is provided with two one-way valves, one of which is connected with one end of the air duct whose another end is in communication with the upper surface of the midsole. The treading action of the foot wearing the shoe causes the air sac to bring about the pumping effect so as to drive out the air inside the shoe via the air duct, the interior of the air sac and the two one-way valves.

The foregoing objectives, structures and functions of the present invention can be more readily understood upon a thoughtful deliberation of the following detailed description of the present invention in conjunction with the accompanying drawings.

DETAILED DESCRIPTION OF THE INVENTION

Figure 1:
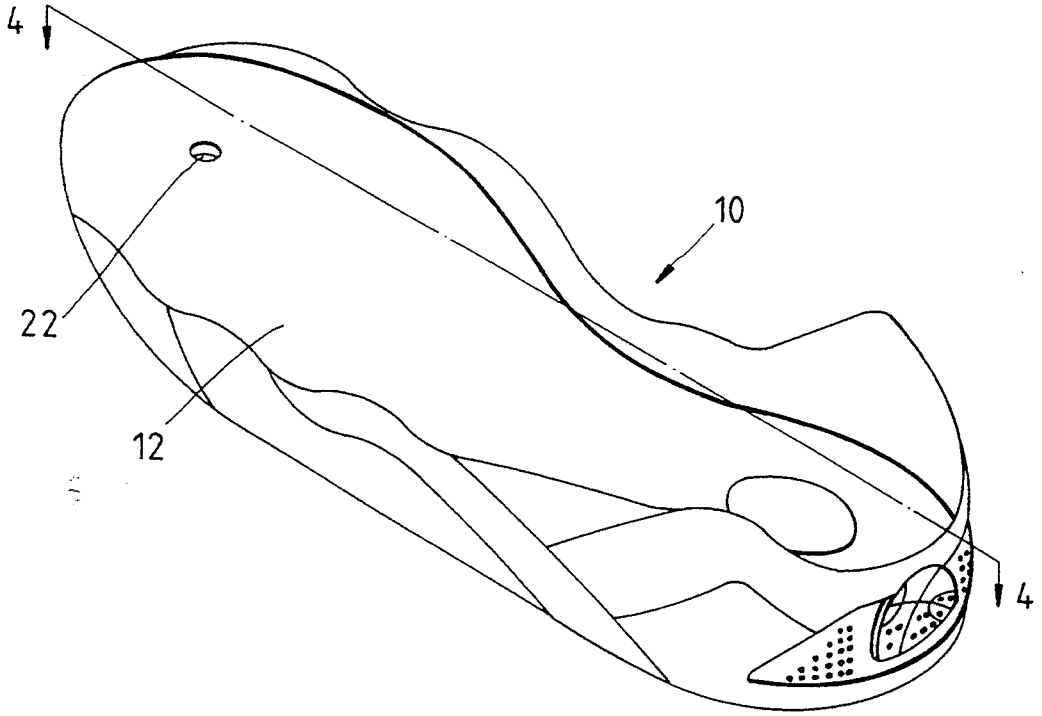
FIG. 1 shows a perspective view of a first preferred embodiment of the present invention.
Figure 2:
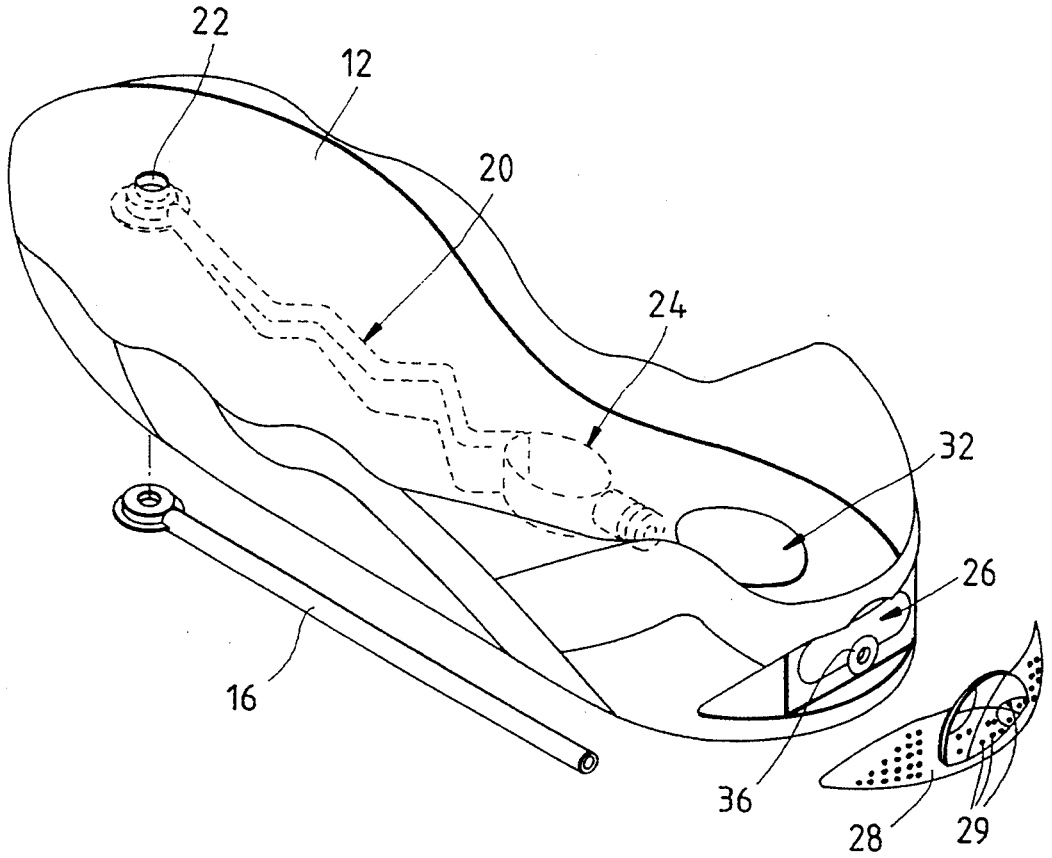
FIG. 2 shows an exploded view of the first preferred embodiment of the present invention.

Referring to FIGS. 1–4, a shoe midsole 10 of the first preferred embodiment of the present invention is shown to comprise a main body 12, an air sac 14 disposed in the interior of the main body 12, and an air duct 16 embedded in the bottom of the main body 12 such that the air duct 16 is in communication with the air sac 14 and the upper surface of the main body 12.

The main body 12 is provided with a curved slot 20, which has a front end extending to reach the upper surface of the main body 12 by means of a through hole 22 and which has a rear end provided with an enlarged receiving portion 24. The main body 12 is provided in the side of the rear end thereof with a recessed portion 26, which is covered with a covering piece 28 having a plurality of air escapes 29.

The air sac 14 of an oval construction is provided with a receiving space 30 having two level surfaces 32 which are located centrally and respectively on the upper and the lower sides thereof. Both level surfaces 32 are of a predetermined height and extend respectively and slightly beyond the upper surface and the lower surface of the main body 12. The air sac 14 has a thickness that is progressively thinner toward the peripheries of the level surfaces 32 from the periphery of the air sac 14. The air sac 14 is provided at the front end thereof with an air admitting one-way valve 34 and at the rear end thereof with an air discharging one-way valve 36. Both one-way valves 34 and 36 are tubular in shape and provided respectively on the outer circumference thereof with a plurality of protuberances 35 which are united with the periphery of the air sac 14 so as to ensure that the one-way valves 34 and 36 are leakproof and that the one-way valves 34 and 36 are not vulnerable to becoming detached. In addition, the one-way valve 34 has one end that extends into the receiving portion 24 of the curved slot 20 while the one-way valve 36 has one end that extends into the recessed portion 26.

The air duct 16 is made of a pliable material and embedded in the curved slot 20 of the main body 12. The air duct 16 has an outer end that is fastened securely and tightly with the air admitting one-way valve 34. The air duct 16 has an inner end of a protruded construction, which is inserted securely into the through hole 22 of the main body 12 in such a manner that the air duct 16 communicates with the upper surface of the main body 12.

The air sac 14 of the shoe midsole 10 of the present invention is corresponding in location to the heel of the shoe. As a result, the treading and the jogging actions of the foot wearing the shoe bring about a pumping effect of the air sac 14. As a result of such pumping effect of the air sac 14, the warm and foul air inside the shoe can be effectively discharged from the air escapes 29 of the covering piece 28 via the air duct 16, the air admitting one-way valve 34, the air sac 14, the air discharging one-way valve 36. In the meantime, the fresh air outside the shoe is drawn into the inside of the shoe via the breathing holes (not shown in the drawings) of the shoe upper.

Figure 5:
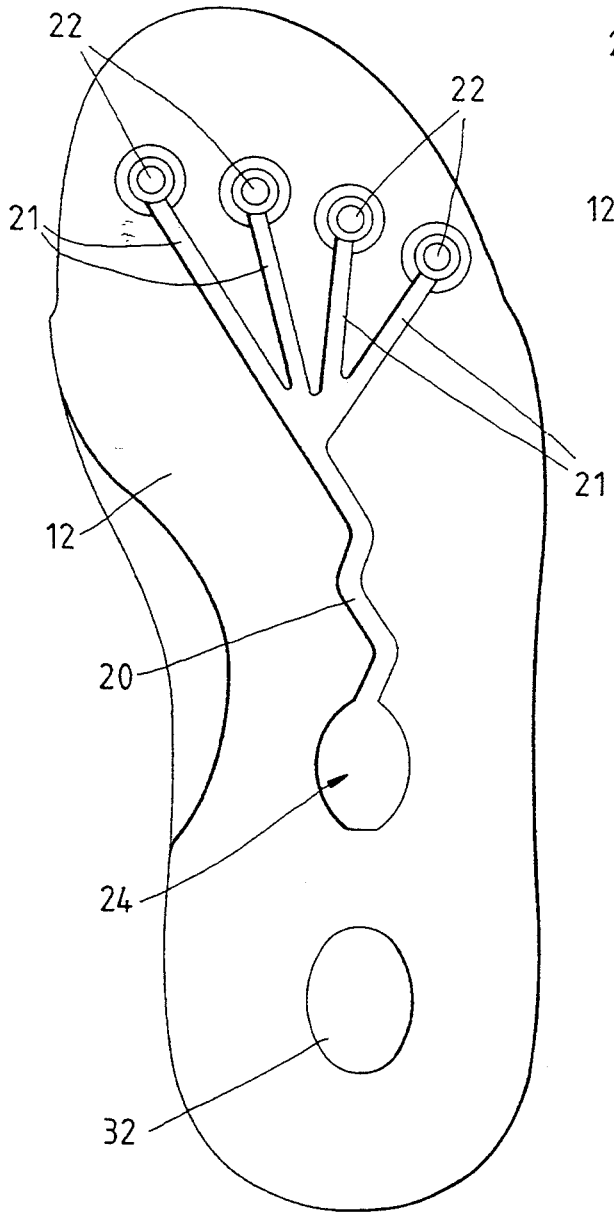
FIG. 5 shows a bottom plan view of a second preferred embodiment of the present invention.
Figure 3:
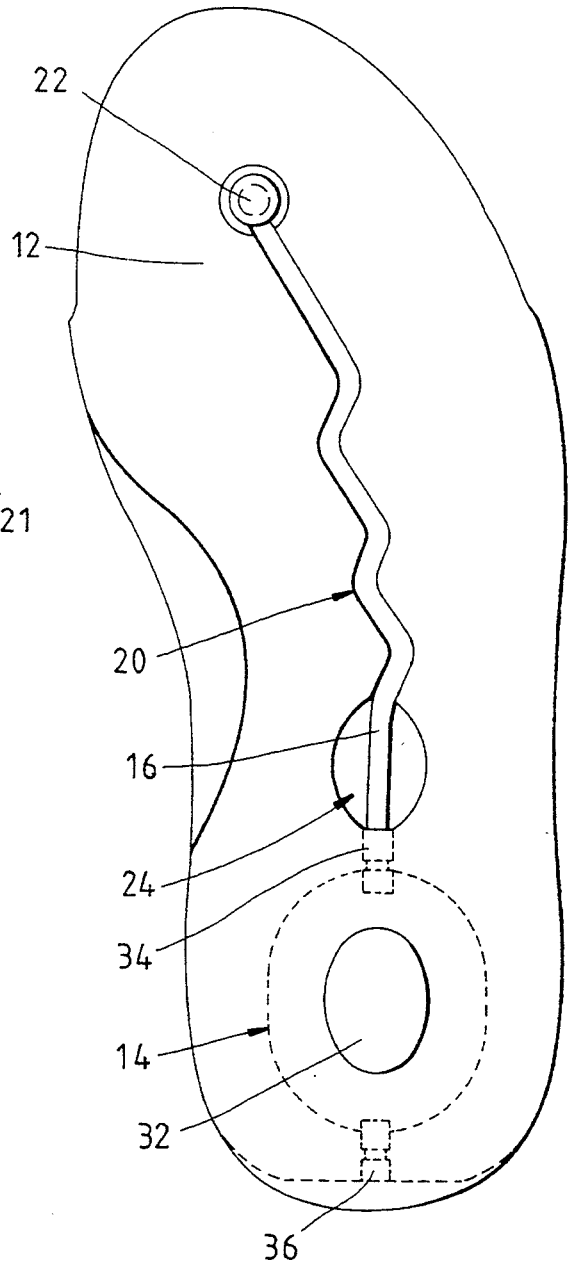
FIG. 3 shows a bottom plan view of the first preferred embodiment of the present invention.
Figure 4:
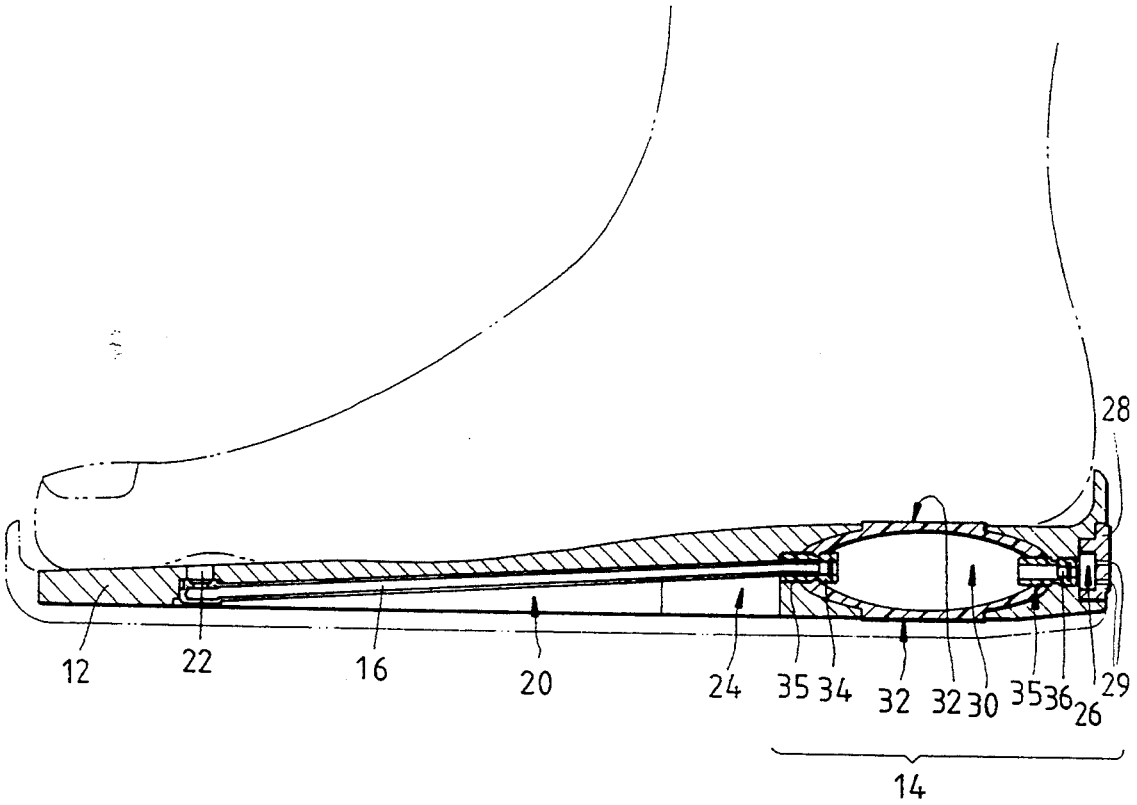
FIG. 4 shows a sectional view of a portion taken along the line 4—4 as shown in FIG. 1.

As shown in FIG. 5, the second preferred embodiment of the present invention is provided with a main body 12 having a slot 20 which has a front end portion separating into four branches 21. Each of the four branches 21 has one end that is provided with a through hole 22 in communication with the upper surface of the main body 12. The front end of the air duct 16 may be connected with any one of the four branches 21. Alternatively, the front end of the air duct 16 may be separated into four branches corresponding in location to the four branches 21 of the slot 20, thereby enabling the air duct 16 to cooperate with each of the four through holes 22 which are corresponding in location to the toes.

Figure 6:
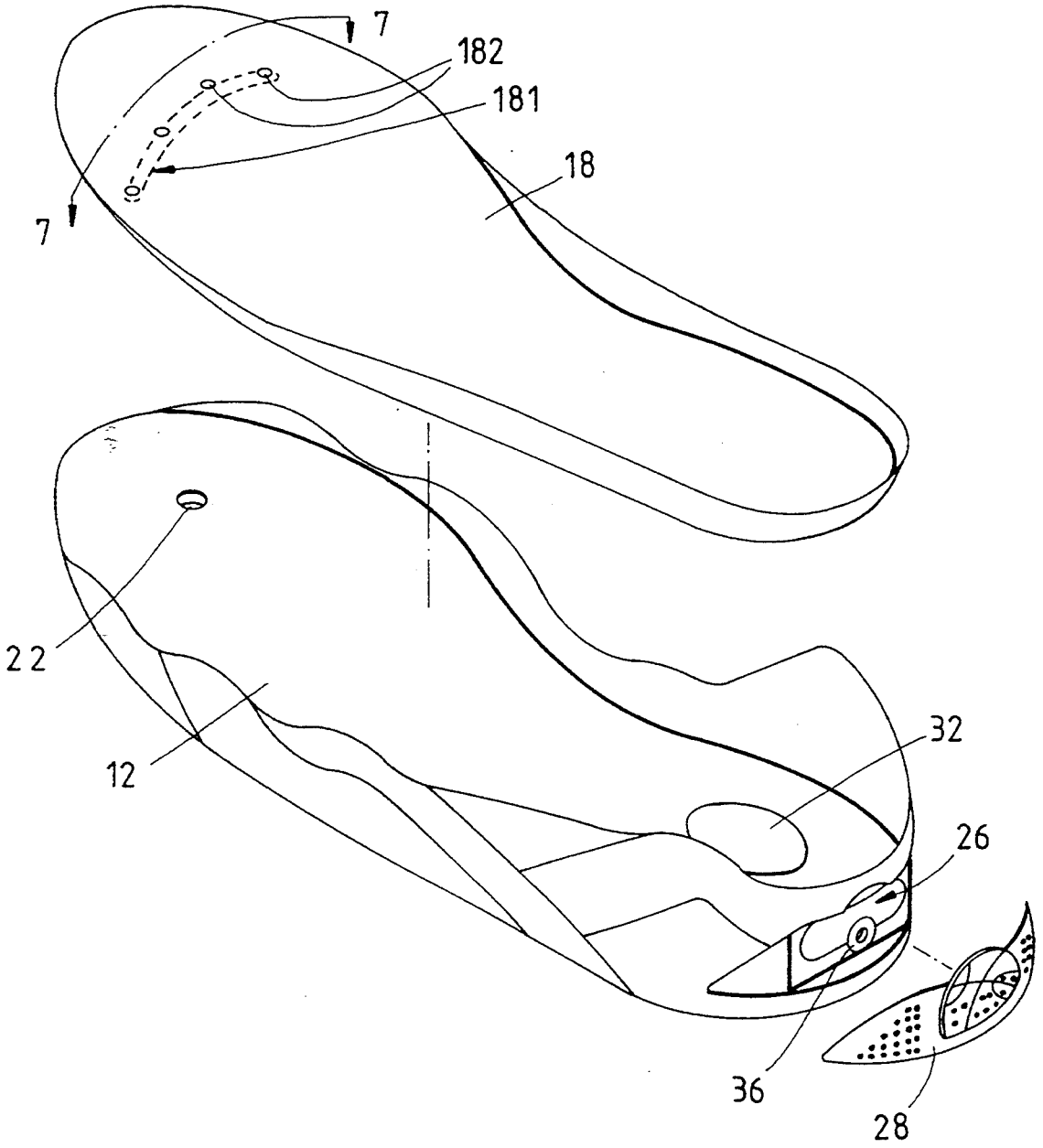
FIG. 6 shows a perspective schematic view of a third preferred embodiment of the present invention.
Figure 7:
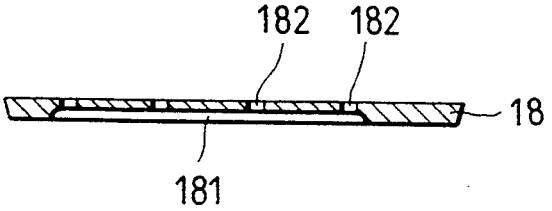
FIG. 7 shows a sectional view of a portion taken along the line 7—7 as shown in FIG. 6.

The third preferred embodiment of the present invention is illustrated in FIGS. 6 and 7, in which the shoe midsole 10 of the present invention is employed in conjunction with an insole 18 which is provided with a first air slot 181 of arcuate construction and corresponding in location to the through holes 22 and the toe. The first air slot 181 is provided with four first air holes 182, each of which extends between the bottom of the first air slot 181 and the upper surface of the insole 18. As a result, the warm and foul air inside the shoe can be more effectively driven out.

Figure 9:
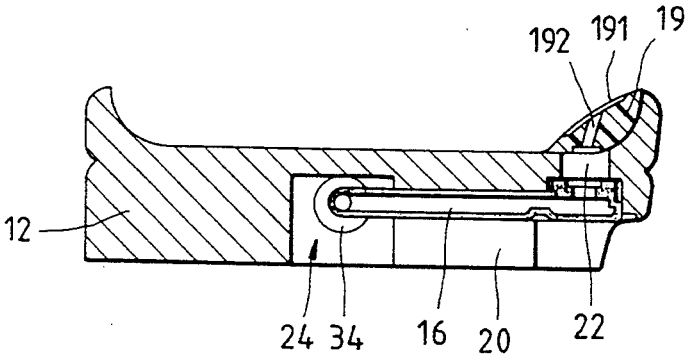
FIG. 9 shows a sectional view of a portion taken along the line 9—9 as shown in FIG. 8.
Figure 8:
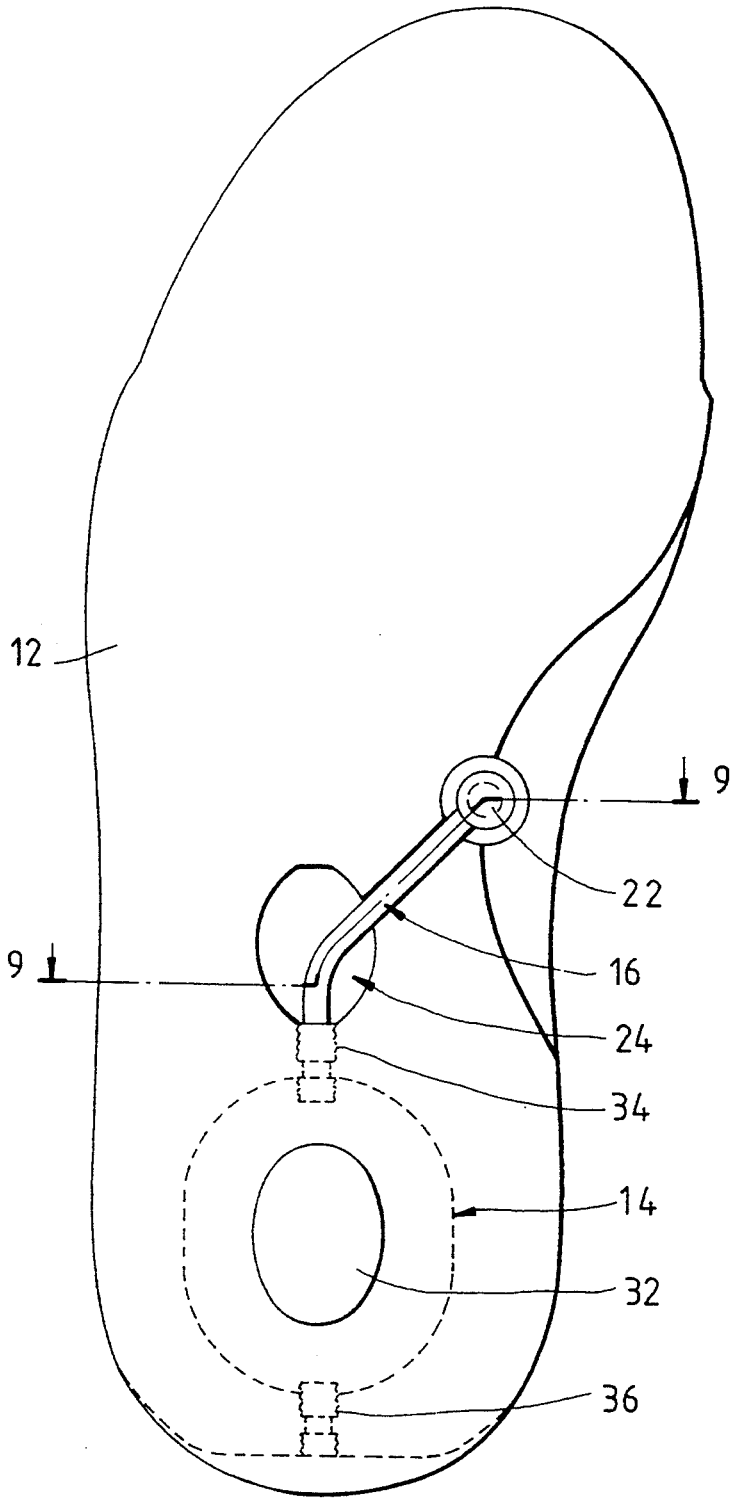
FIG. 8 shows a bottom plan view of a fourth preferred embodiment of the present invention.

As illustrated in FIGS. 8 and 9, the fourth preferred embodiment of the present invention is provided with a slot 20 which extends to cover not only the front section of the main body 12 but also the midsection of the main body 12 which is corresponding in location to the plantar arch of the foot. It must be noted here that most of the athletic shoes are furnished with a slanted pliable pad 19, which is corresponding in location to the plantar arch. For this reason, the pad 19 of the present invention is provided thereon with a second air slot 191 which in turn is provided in the bottom thereof with a second air hole 192 extending to reach the lower side of the pad 19 in such a manner that the second air hole 192 is corresponding in location to the front end portion of the air duct 16.

The embodiments of the present invention described above are to be regarded in all respects as merely illustrative and not restrictive. Accordingly, the present invention may be embodied in other specific forms without deviating from the spirits thereof. The present invention is therefore to be limited only by the scope of the following appended claims.

What is claimed is:

1. A compression cooling system of a shoe midsole comprising:

a main body provided in a lower side thereof with a slot of a predetermined length and having a through hole extending from a front end of said slot to reach an upper surface of said main body;

an air sac disposed in a rear segment of said main body and provided in a periphery thereof with an air admitting one-way valve and an air discharging one-way valve which are separated by an appropriate distance, with said air admitting one-way valve being in communication with said slot, and with said air discharging one-way valve being in communication with an outer surface of said main body; and an air duct disposed in said slot such that a rear end of said air duct is connected with said air admitting one-way valve and that a front end of said air duct is in communication with said through hole;

wherein said air sac is provided respectively on an upper surface thereof and a lower surface thereof with a level surface, each said level surface respectively spaced slightly out from an upper and a lower surface of said main body, wherein said front end of said air duct can be caused to bring about a stream of suction at the time when said air sac is compressed and decompressed, with said suction being capable of drawing atmospheric air into said air sac from which said atmospheric air is then driven out via said air discharging one-way valve.

2. The compression cooling system of a shoe midsole of claim 1 wherein said slot has a front end which is separated into a plurality of branches, with each of said branches provided at one end thereof with a through hole communicating with said upper surface of said main body.

3. The compression cooling system of a shoe midsole of claim 1 further comprising an insole provided in a lower surface thereof with a first air slot and a plurality of first air holes communicating with said upper surface of said main body .and with said first air slot which is corresponding in location to said through hole.

4. The compression cooling system of a shoe midsole of claim 1 further comprising a pad disposed on a middle segment of said main body and provided in an upper portion thereof with a second air slot and in a lower portion thereof with a second air hole communicating with said second air slot, with said slot extending to reach a position under said second air hole.

5. The compression cooling system of a shoe midsole of claim 1 wherein said air admitting one-way valve and said air discharging one-way valve are provided respectively on peripheries thereof with a plurality of circularly arranged protuberances which are united with a periphery of said air sac.

6. The compression cooling system of a shoe midsole of claim 1 wherein said air sac has an empty interior and a periphery of a thickness which becomes progressively thinner from a midsection thereof toward an upper portion thereof or a lower portion thereof.

7. The compression cooling system of a shoe midsole of claim 1 further comprising a recessed portion located in a predetermined portion of a periphery of said main body, with said recessed portion having an outer edge with a covering piece fastened thereto and provided with a plurality of air escapes.

* * * * *